US006290419B1

(12) United States Patent
Hirschmann

(10) Patent No.: US 6,290,419 B1
(45) Date of Patent: Sep. 18, 2001

(54) WRITING TOOL

(75) Inventor: Michael Hirschmann, Vienna (AT)

(73) Assignee: Trodat GmbH, Wels (AT)

( * ) Notice: Subject to any disclaimer, the term of this patent is extended or adjusted under 35 U.S.C. 154(b) by 0 days.

(21) Appl. No.: 09/600,803

(22) PCT Filed: Jan. 12, 1999

(86) PCT No.: PCT/AT99/00007

§ 371 Date: Sep. 21, 2000

§ 102(e) Date: Sep. 21, 2000

(87) PCT Pub. No.: WO99/37487

PCT Pub. Date: Jul. 29, 1999

(30) Foreign Application Priority Data

Jan. 20, 1998 (AU) ..... 82/98

(51) Int. Cl.[7] ..... B43K 29/013
(52) U.S. Cl. ..... 401/195; 401/117; 101/333
(58) Field of Search ..... 401/52, 117, 195; 101/333

(56) References Cited

U.S. PATENT DOCUMENTS

| | | | | |
|---|---|---|---|---|
| 300,440 | * | 6/1884 | Blitz . | |
| 317,853 | * | 5/1885 | Richford . | |
| 334,008 | * | 1/1886 | Emerson . | |
| 396,233 | * | 1/1889 | Reynolds . | |
| 1,085,143 | * | 1/1914 | Malsch . | |
| 2,627,227 | * | 2/1953 | Claggett et al. . | |
| 4,606,665 | | 8/1986 | Schleif et al. | 401/195 |
| 5,118,212 | * | 6/1992 | Shao | 401/195 |
| 6,120,204 | * | 9/2000 | Rigoni | 401/195 |

FOREIGN PATENT DOCUMENTS

| | | | | |
|---|---|---|---|---|
| 2827542 | * | 1/1980 | (DE) | 401/195 |
| 8700113 U | * | 5/1988 | (DE) . | |
| 2519584 | * | 7/1983 | (FR) | 401/195 |
| 2672246 | * | 8/1992 | (FR) | 401/195 |

* cited by examiner

*Primary Examiner*—Charles R. Eloshway
(74) *Attorney, Agent, or Firm*—Karl Hormann

(57) ABSTRACT

A writing instrument has a housing (6) which holds in a section (5) opposite to a writing utensil a stamping device with an ink pad (3) and a stamping plate (2). The stamping plate (2) is mounted in a holder (1) movable with respect to the housing section (5) and can swivel about a transverse axis between a swung out work position transverse to the holder (1) and a rest position in which it is swung against the holder (1) and lies against the ink pad (3). In order to create an advantageous design, the holder (1) in the housing section (5) and the ink pad (3) in the housing insert (7) can be moved independently in the direction of the axis of the housing up to a stop and the housing insert (7) in the housing section (5) can be moved transversely to the ink pad (3) and lifted off the holder (1) against the force of a spring.

6 Claims, 5 Drawing Sheets

WRITING TOOL

BACKGROUND OF THE INVENTION

1. Field of the Invention

The invention relates to a writing instrument with a housing for receiving, in a housing section positioned opposite a writing utensil, a stamping device with an ink pad and a stamp plate which is supported by a stamp bracket slidable relative to the housing section, for rotation about a transverse axis between an operating position pivoted transversely outwardly relative to the stamp bracket and an idle position pivoted inwardly against the stamp bracket in which the stamp plate engages the ink pad.

2. The Prior Art

In order to combine a stamping device with a ball point pen to form a structural unit, it is known (U.S. Pat. No. 4,606,665) to insert a stamp bracket into the housing of the ball point pen, the stamp bracket supporting a stamp plate on the one hand and an ink pad on the other. Whereas the stamp plate is mounted at its longitudinal center for rotation about a transverse axis on the stamp bracket and is pivotable from an idle position in which it engages the stamp bracket to an operating position extending transversely of the housing, the ink pad is linked to one end of the stamp bracket set back by half the length of the stamp plate relative to the stamp plate connection, so that the ink pad, when the stamp plate is pivoted inwardly to its idle position against the stamp bracket, may be pivoted inwardly from its spread out position against the stamp plate in order to ink the image face of the stamp plate for the next stamping operation. In this position, the stamp device may be secured by a cap-like housing section pushed over it and which must be pulled off for using the stamping device. As this cap-like housing section is pulled off the ink pad is spread away from the stamp bracket by an appropriate spring force and the stamp plate is thus released which may then pivot into its operating position under the force of gravity. A major disadvantage of this known writing instrument is that the ink pad, which must be spread outwardly to release the stamp plate, interferes with the working of the stamping device, and that soiling is likely to result if the ink pad is touched while the stamping device is being used.

OBJECT OF THE INVENTION

Therefore, it is the task of the invention structurally to design a writing instrument of the kind referred to supra such that its operation is simplified while reducing the possibility of soiling.

SUMMARY OF THE INVENTION

In accordance with the invention, the task is accomplished by the stamp bracket in the housing section and the ink pad in a housing insert being mounted for sliding movement limited by an abutment, and independent of each other, in the direction of the axis of the housing and by the housing insert being transversely displaceable of the ink pad in the housing section and liftable from the stamp bracket against the force of a spring.

These measures result in the ink pad being associated with a housing insert separate from the stamp bracket, and the stamp bracket can thus be mounted for sliding axial movement in a housing section integral with the housing so that it may be pushed along guides sufficiently far out of the housing section to allow the stamp plate which is pivotally mounted on the stamp bracket to pivot from its idle position in engagement with the stamp bracket into its operating position. During a stamping operation the ink pad stays within the housing section so that operating the stamping device is not adversely affected by an outwardly spread ink pad. For moving the stamp plate when pivoted against the stamp bracket without interference by the ink pad when the stamp bracket is sliding along the housing section and for pressing the ink pad against the stamp plate for inking is image face, the housing insert receiving the ink pad may be displaced in the housing section transversely of the ink pad and may be lifted off the stamp bracket against the force of a spring. When the housing insert and the ink pad are lifted off the stamp bracket against the spring force, the stamp bracket is rendered freely slideable relative to the housing insert and may be displaced from its inserted idle position to its extended operating position. Advantageously, this takes place under its own weight. In its inserted idle position the ink pad is pressed against the stamp plate by the bias of the spring of the housing insert in which it is received. This advantageously facilitates inking of the image face. While there is no need for a stamping operation axially to displace the ink pad relative to the housing insert, the ink pad is nevertheless mounted for axial movement in the housing insert so that stamp ink may be fed to the ink pad. To this end, the ink pad need only be withdrawn through the front end of the housing section along the slide guide in the housing insert. As the stamp bracket then stays within the housing section, the withdrawn ink pad is freely accessible for refilling of stamp ink.

The stamp bracket may be axially latched in its inserted idle position, as well as in its extended operating position, relative to the housing section in which it is supported. Latching may be accomplished simply by an appropriate latching abutment or catch formed in the housing insert. Due to the lateral displacement of the housing insert and its spring bias, the housing insert fulfills all requirements for such a catch. The stamp bracket need merely form a corresponding counter catch which is released by the latching abutment as the housing insert is lifted off the stamp bracket, so that the stamp bracket may be displaced in the housing section along its slide guide. In the terminal positions of the stamp bracket as defined by the abutments, the latching abutment of the housing insert, acting under the bias of the spring, moves behind the counter abutment of the stamp bracket. For displacing the housing insert to unlatch the stamp bracket, the housing insert may be manually moved against the spring bias by an actuator extending through an opening in the housing.

While the stamp plate is longitudinally slideable within the housing section when it is pivoted against the stamp bracket, it will be structurally arrested, when in its outwardly pivoted position, relative to the stamp bracket which is also slidably mounted within the housing section. This facilitates the inking of the image face mounted on the stamp plate when the ink pad is pressed against the stamp support.

In order to be able not only to feed stamp ink to the ink pad but also to replace the ink pad, as required, the ink pad may be removably inserted into the slide guide of the housing insert which, due to the existing slide guide of the ink pad in the housing section, requires no additional structural means.

DESCRIPTION OF THE SEVERAL DRAWINGS

The embodiment of the invention is exemplary depicted in the drawings, in which.

DETAILED DESCRIPTION OF THE PREFERRED EMBODIMENT

Figure 1:
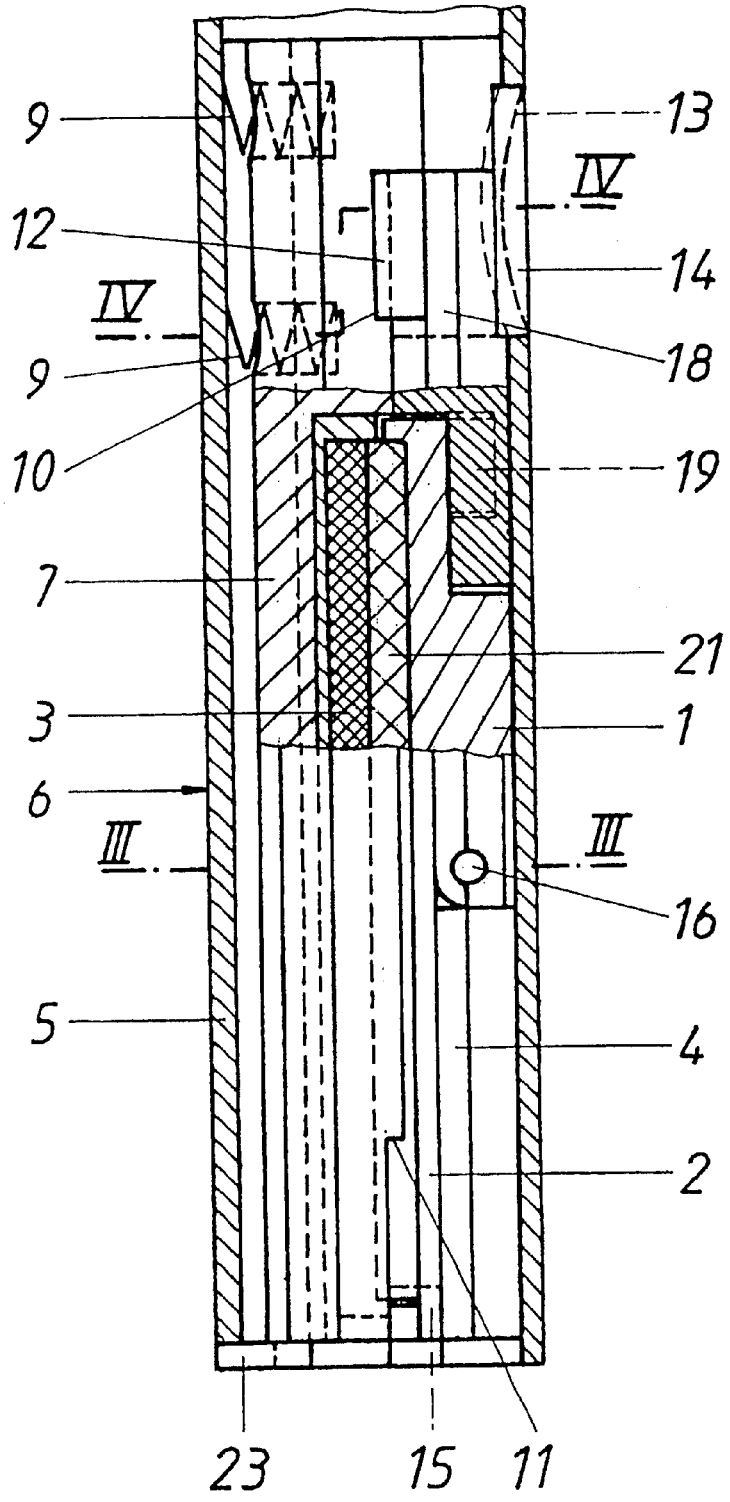
FIG. 1 depicts the stamping device of a writing instrument in accordance with the invention in a partial side elevation.

In the embodiment shown the stamping device consists of a stamp bracket 1 with a stamp plate 2 hinged to it as well as of an ink pad 3. Whereas the stamp bracket 1 is mounted for slideable movement in axial guides 4 of a housing section 5 of the housing 6 of a writing instrument not described in any detail, which at its end opposite the stamping device supports a writing utensil, such as, for instance, a ball-point refill, the ink pad 3 is supported for axial displacement on a housing insert 7 which may be laterally displaced between two parallel side walls 8 of the housing section 8 relative to the axis of the housing and which is biased by springs 9 towards the stamp bracket 1. The housing insert 7 forms latching abutments 10 and 11 which cooperate with counter abutments 12 of the stamp bracket 1.

Figure 2:
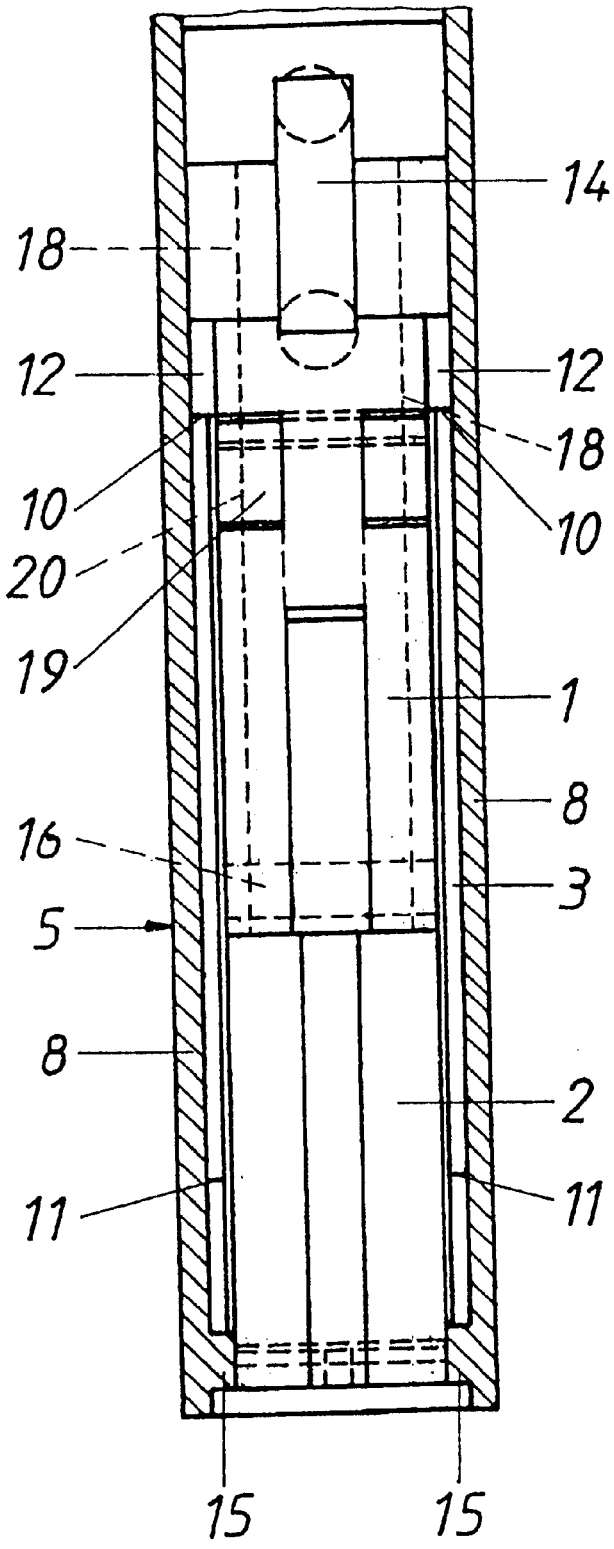
FIG. 2 depicts the stamping device in top elevation.
Figure 5:
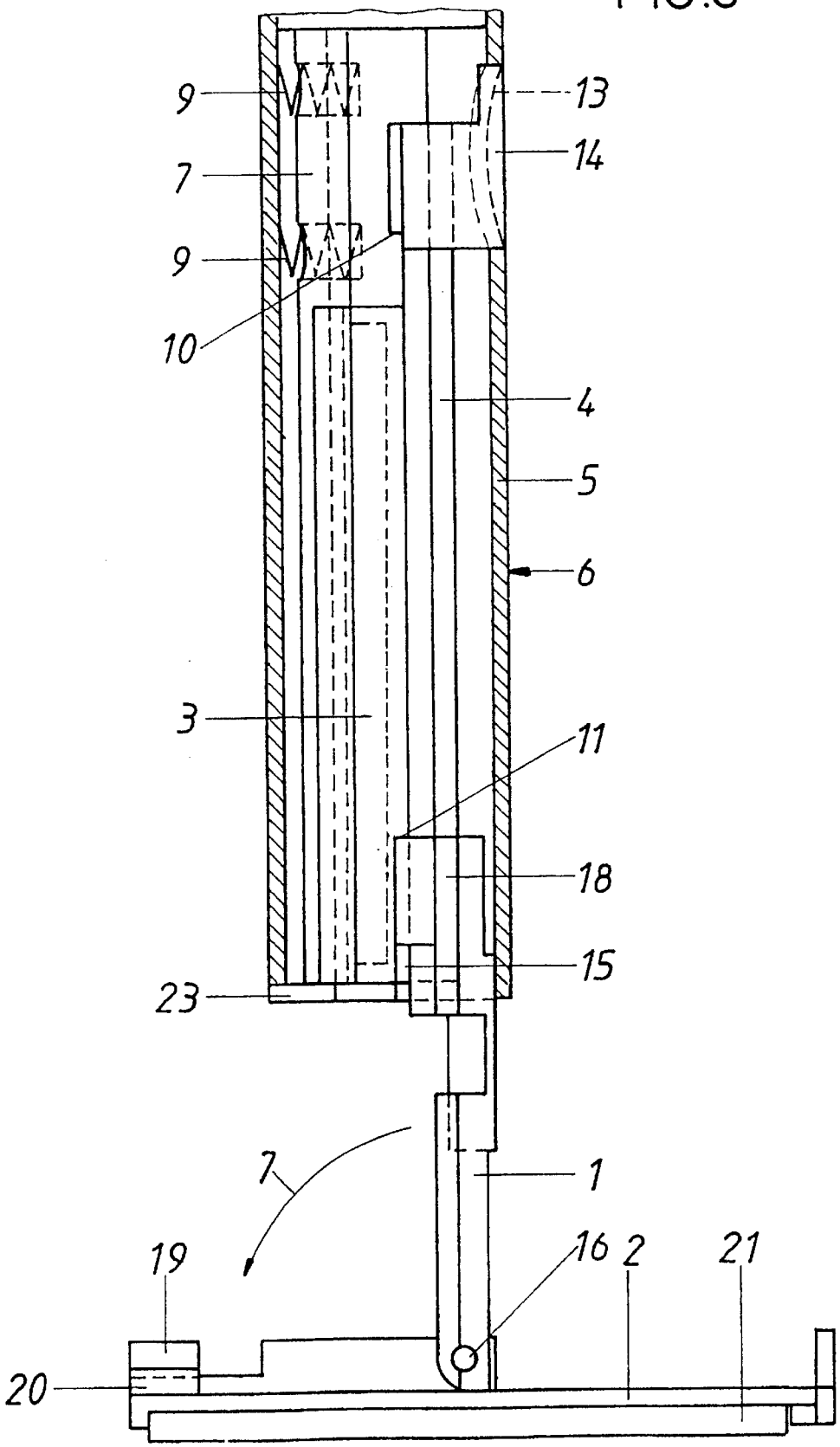
FIG. 5 is a side view of the stamping device in its operating position.

In the idle position shown in FIGS. 1 and 2, in which the stamp bracket 1 is wholly inserted in the housing section 5, the latching abutment 10 extends behind the counter abutment 12 protruding towards the housing insert 7. Accordingly, the stamp bracket 1 is secured against axial movement out of the housing section 5. If, by an actuator knob 14 protruding through an opening 13 in the housing, the housing insert 7 is moved, against the force of the springs 9, into its unlatched position shown in FIG. 6, the counter abutment 12 will be released from the latching abutment 10. As a result of the release the stamp bracket 1 may be pushed out of the housing section 5 along the guides 4, since the ink pad 3 is lifted off the stamp plate 2 as the housing insert 7 is laterally displaced. Given certain tolerances of the guides 4, the stamp bracket 1 may slide out of the housing section 5 under its own weight until the counter abutment 12 of the stamp bracket 1 engages a housing abutment 15 by which the extent of movement of the stamp bracket 1 is limited, as particularly shown in FIG. 2. If the actuator knob 14 of the housing insert 7 is released in this abutting position of the stamp bracket 1, the springs 9 will again press the housing insert 7 against the stamp bracket 1, with a latching abutment 11 provided near the ink pad 3 extending behind the counter abutment 12 of the stamp bracket 1, thus locking the stamp bracket 1 in its operating position as shown in FIG. 5. The stamp plate 2 may now be pivoted about its center hinge pin 16 to perform a stamping operation. The stamp plate 2 is structured asymmetrically so that its weight biases the stamp plate in the direction of its operating position, as indicated by arrow 17 in FIG. 5.

To pivot the stamp plate 2, the housing 6 need simply be held with the writing tip pointing downwardly and the stamping device pointing upwardly so that the stamp plate pivots inwardly to its idle position against the stamp bracket 1 from its operating position of FIG. 5. By depressing the actuator button 14, the stamp bracket 1 in this position of the stamping device with the inwardly pivoted stamp plate 2 will slide into the housing section 5 under its own weight. Since for receiving the guides 4, the stamp bracket 1 is provided with grooves 18 and the stamp plate 2 is provided with grooves 20 at its end 19 which pivots against the stamp bracket 1, the stamp plate 2 when moving into the housing section 5 will also be guided so that the inwardly pivoted position of the stamp plate 2 is secured during movement of the stamp bracket 1 within the housing.

Figure 3:
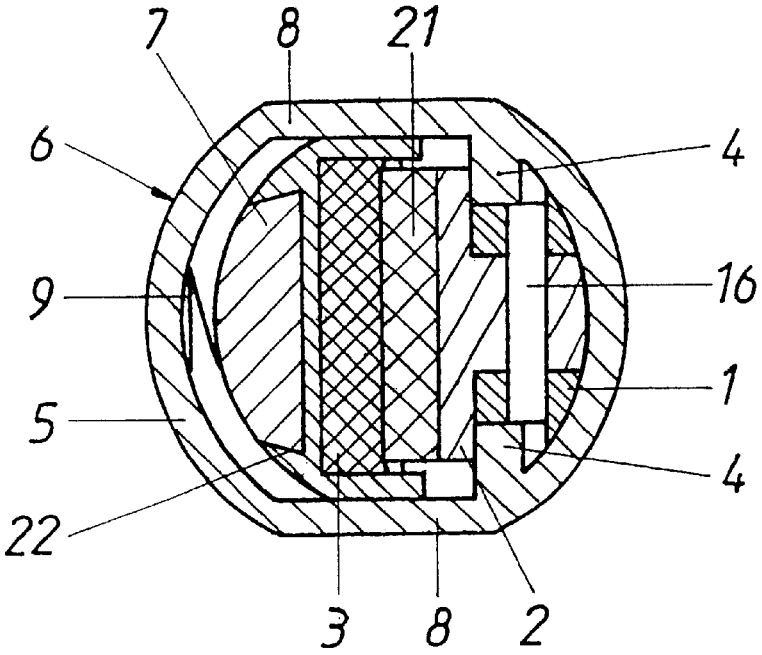
FIG. 3 is a sectional view on an enlarged scale along line III—III of FIG. 1.
Figure 4:
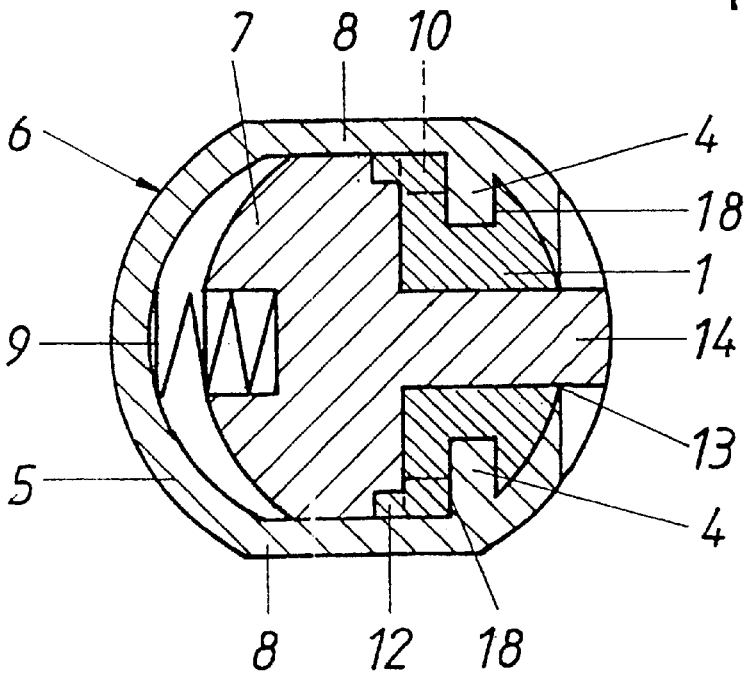
FIG. 4 is a sectional view on an enlarged scale along line IV—IV of FIG. 1.
Figure 6:
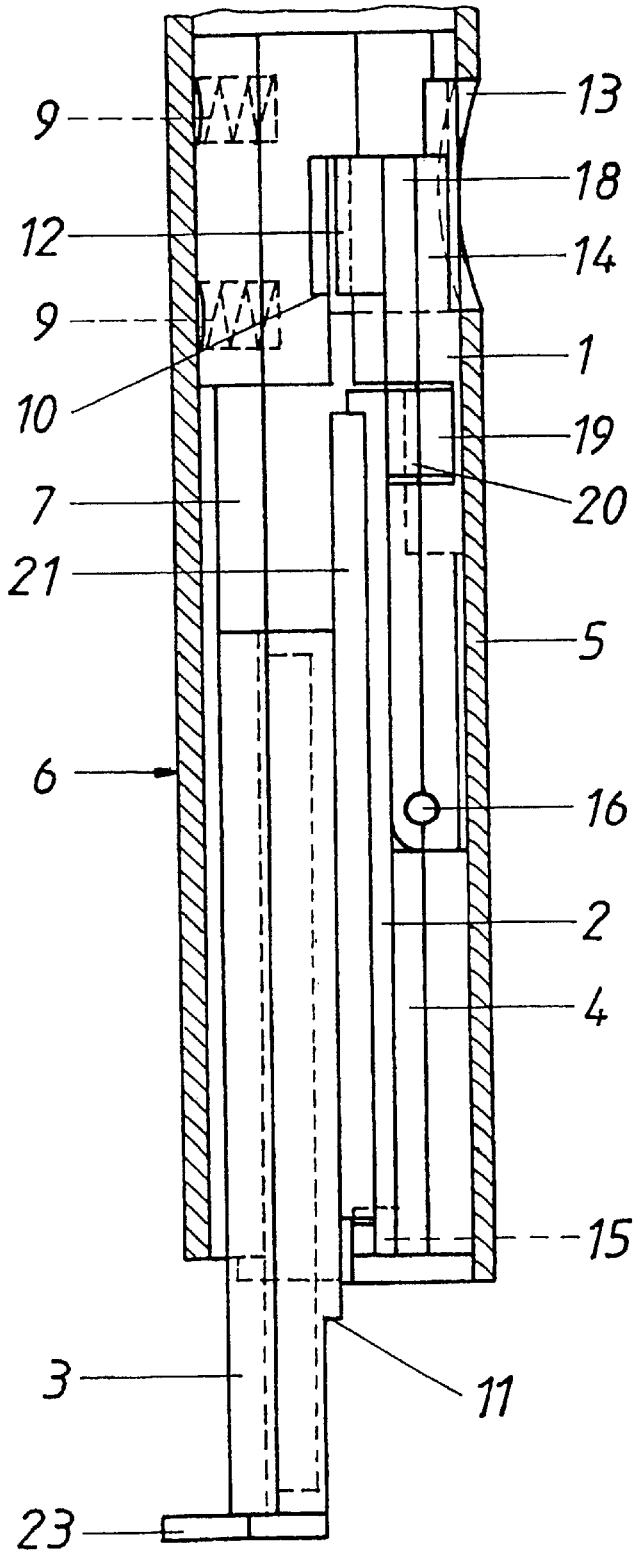
FIG. 6 depicts the stamping device in side elevation with partially pulled out ink pad.

As has already been mentioned, for securing the stamp bracket 1 in its inserted idle position, the housing insert 7 is pressed against the stamp bracket 1 by the force of the springs 9 once the actuator knob 14 is released. Hence, in the idle position of the stamp bracket 1 the image face 21 is inked in preparation for a subsequent stamping operation. For feeding stamp ink to the ink pad 3, the ink pad 3 may be pulled out of the housing section 5 along a feathered guide groove 22 (FIG. 3) formed in the housing insert 7, through an end plate 23 covering the front of the housing section 5 near the housing insert 7. This requires displacement of the housing insert 7 by the actuator knob 14 into its unlatched position, where the ink pad 3, lifted off the stamp plate 2, may be manually withdrawn from the housing section 5 as shown in FIG. 6. For withdrawing or, if necessary, replacing the ink pad 3, it is recommended to hold the housing in a position in which the stamp bracket 1 is prevented from sliding out of the housing section 5, in view of the fact that the stamp bracket 1 is released when the housing insert 7 is displaced into its unlatched position. The guide groove 22 is structurally designed such that frictional forces prevent weight-induced sliding of the ink pad 3 relative to the housing insert 7. This simple expedient prevents the ink pad 3 from sliding out of the housing section 5 with the stamp bracket 1.

What is claimed is:

1. A writing instrument, comprising:

a housing having a first end for accommodating a writing utensil and an opposite end forming an elongate chamber extending substantially axially of the housing;

a stamp plate hingedly connected to a stamp bracket for movement between a position substantially parallel to the stamp bracket and a position substantially normal to the stamp bracket;

first means for mounting the stamp bracket in the chamber for movement between a first position in which the stamp plate is disposed within the chamber and a second position in which the stamp plate is disposed outside of the chamber;

an ink pad;

second means for mounting the ink pad in the chamber for movement between a first position within the chamber and a second position outside of the chamber; and means for resiliently biasing the ink pad in its first position against the stamp plate when the stamp bracket is in its first position.

2. The writing instrument of claim 1, wherein the first means for mounting the stamp pad and the second means for mounting the ink pad are mounted for movement axially of the chamber independently of each other.

3. The writing instrument of claim 1, further comprising means for releasably latching the stamp bracket in its first and second positions.

4. The writing instrument of claim 1, further comprising an image face mounted on the stamp plate in a position between the ink pad and the stamp plate when the stamp bracket is in its first position.

5. The writing instrument of claim 1, wherein the ink pad is mounted on the second mounting means for removal therefrom when in its second position.

6. The writing instrument of claim 1, wherein the stamp plate is asymmetrically hinged to the stamp bracket.

* * * * *